US011141984B2

(12) United States Patent
Saigusa et al.

(10) Patent No.: US 11,141,984 B2
(45) Date of Patent: Oct. 12, 2021

(54) TANK WITH TANK MAIN BODY AND LID

(71) Applicant: RISO KAGAKU CORPORATION, Tokyo (JP)

(72) Inventors: Toshiya Saigusa, Ibaraki (JP); Hiroshi Sugitani, Ibaraki (JP); Takehiro Yamori, Ibaraki (JP)

(73) Assignee: RISO KAGAKU CORPORATION, Tokyo (JP)

( * ) Notice: Subject to any disclaimer, the term of this patent is extended or adjusted under 35 U.S.C. 154(b) by 0 days.

(21) Appl. No.: 16/676,863

(22) Filed: Nov. 7, 2019

(65) Prior Publication Data

US 2020/0247131 A1 Aug. 6, 2020

(30) Foreign Application Priority Data

Jan. 31, 2019 (JP) ..... JP2019-015589

(51) Int. Cl.
*B41J 2/175* (2006.01)
*B65D 43/02* (2006.01)
*B65D 53/00* (2006.01)

(52) U.S. Cl.
CPC ..... *B41J 2/17513* (2013.01); *B65D 43/0202* (2013.01); *B41J 2/17509* (2013.01); *B41J 2/17556* (2013.01); *B65D 53/00* (2013.01)

(58) Field of Classification Search
CPC ..... B41J 2/17513; B41J 2/17509; B41J 2/17556; B41J 2/17503; B41J 2/175; B65D 43/02; B65D 43/0202; B65D 53/00
See application file for complete search history.

(56) References Cited

U.S. PATENT DOCUMENTS

| | | | |
|---|---|---|---|
| 9,139,012 | B2 | 9/2015 | Yamada et al. |
| 9,469,118 | B2 | 10/2016 | Kimura et al. |
| 9,493,010 | B2 | 11/2016 | Kudo et al. |
| 9,511,592 | B2 | 12/2016 | Kobayashi et al. |
| 9,764,556 | B2 | 9/2017 | Kudo et al. |
| 10,315,429 | B2 | 6/2019 | Shirono et al. |

FOREIGN PATENT DOCUMENTS

| | | | | |
|---|---|---|---|---|
| CN | 203063281 | U | | 7/2013 |
| CN | 104553334 | A | | 4/2015 |
| CN | 104772991 | A | | 7/2015 |
| CN | 105966072 | A | | 9/2016 |
| CN | 106004058 | A | | 10/2016 |
| CN | 206394244 | U | | 8/2017 |
| CN | 107264050 | A | | 10/2017 |
| CN | 107471827 | A | | 12/2017 |
| JP | 10-95128 | | | 4/1998 |
| JP | H1095128 | A | * | 4/1998 |

OTHER PUBLICATIONS

Official Action in counterpart Chinese Patent Application No. 201911154599.3, dated Jan. 29, 2021.

* cited by examiner

*Primary Examiner* — Jannelle M Lebron
(74) *Attorney, Agent, or Firm* — Greenblum & Bernstein P.L.C.

(57) ABSTRACT

A tank includes a tank main body configured to house liquid and a lid configured to cover an upper side of the tank main body. The tank main body includes an atmosphere communication hole having an opening opened on an upper surface of the tank main body and a lowered step portion dug down from a periphery of the opening. The lid includes a recess formed on a lower surface of the lid and facing the opening.

5 Claims, 8 Drawing Sheets

TANK WITH TANK MAIN BODY AND LID

CROSS REFERENCE TO RELATED APPLICATION

This application is based upon and claims the benefit of priority from the prior Japanese Patent Application No. 2019-015589, filed on Jan. 31, 2019, the entire contents of which are incorporated herein by reference.

BACKGROUND

1. Technical Field

The disclosure relates to a tank configured to house liquid.

2. Related Art

Japanese Patent Application Publication No. Hei 10-95128 describes a tank which houses liquid and which is configured such that the liquid flows into and out from the tank. In this tank, an atmosphere communication hole for causing an inside of the tank to communicate with the atmosphere is provided to maintain the inner pressure of the tank constant (atmospheric pressure) irrespective of changes in the amount of the liquid.

SUMMARY

In the aforementioned tank, when the liquid enters the atmosphere communication hole, the liquid blocks the atmosphere communication hole and the inside of the tank is isolated from the atmosphere in some cases. In this case, the inner pressure cannot be maintained constant. Accordingly, an opening of the atmosphere communication hole is arranged at such a position that the liquid housed in the tank does not enter the atmosphere communication hole.

However, even when the opening of the atmosphere communication hole is arranged at such a position that the liquid housed in the tank does not enter the atmosphere communication hole as described above, the liquid attaching to a lid of the tank sometimes enters the atmosphere communication hole.

The disclosure is directed to a tank which can prevent liquid from entering an atmosphere communication hole.

A tank in accordance with some embodiments includes a tank main body configured to house liquid and a lid configured to cover an upper side of the tank main body. The tank main body includes an atmosphere communication hole having an opening opened on an upper surface of the tank main body and a lowered step portion dug down from a periphery of the opening. The lid includes a recess formed on a lower surface of the lid and facing the opening.

According to the aforementioned configuration, the liquid can be prevented from entering the atmosphere communication hole.

DETAILED DESCRIPTION

Figure 1:
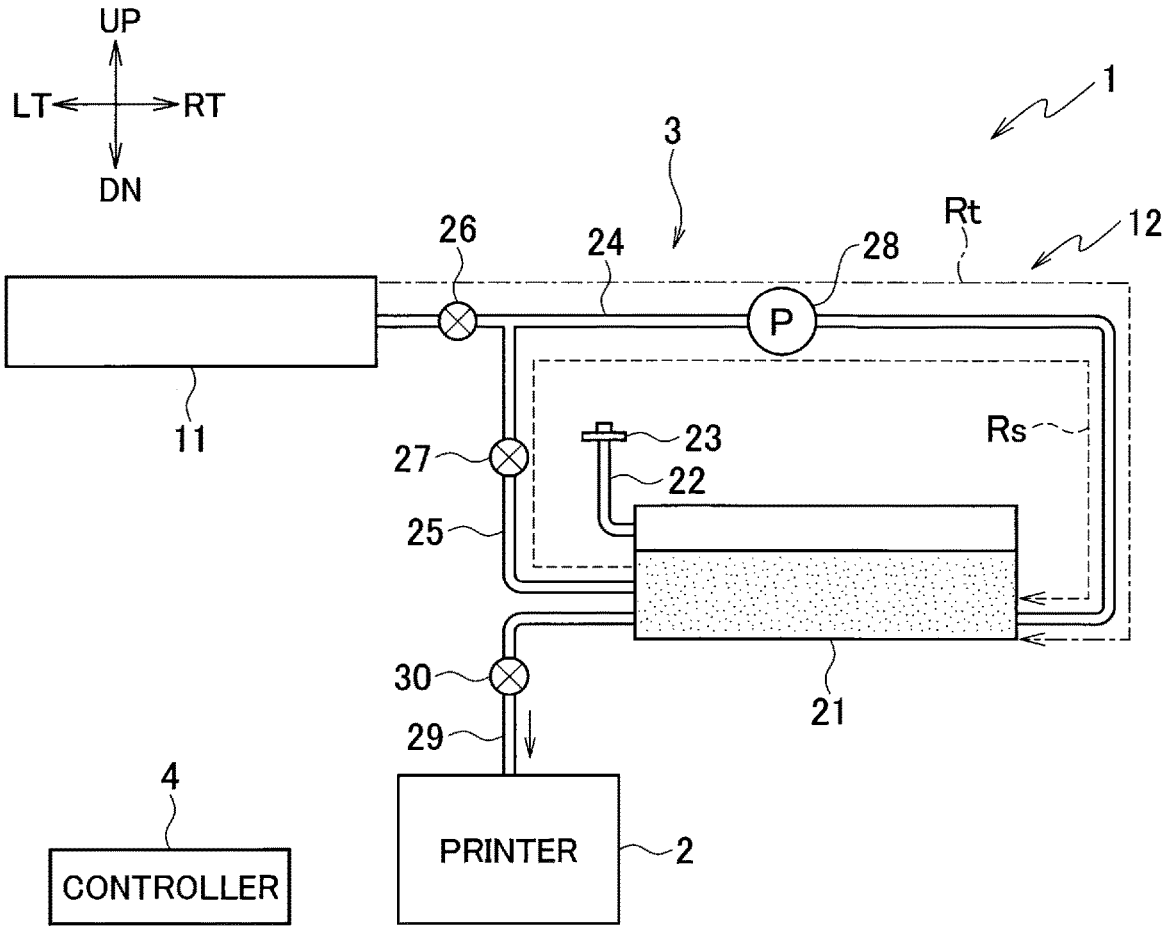
FIG. 1 is a schematic configuration diagram of a printing apparatus provided with a tank according to an embodiment.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

Description will be hereinbelow provided for an embodiment of the present invention by referring to the drawings. It should be noted that the same or similar parts and components throughout the drawings will be denoted by the same or similar reference signs, and that descriptions for such parts and components will be omitted or simplified. In addition, it should be noted that the drawings are schematic and therefore different from the actual ones.

Figure 2:
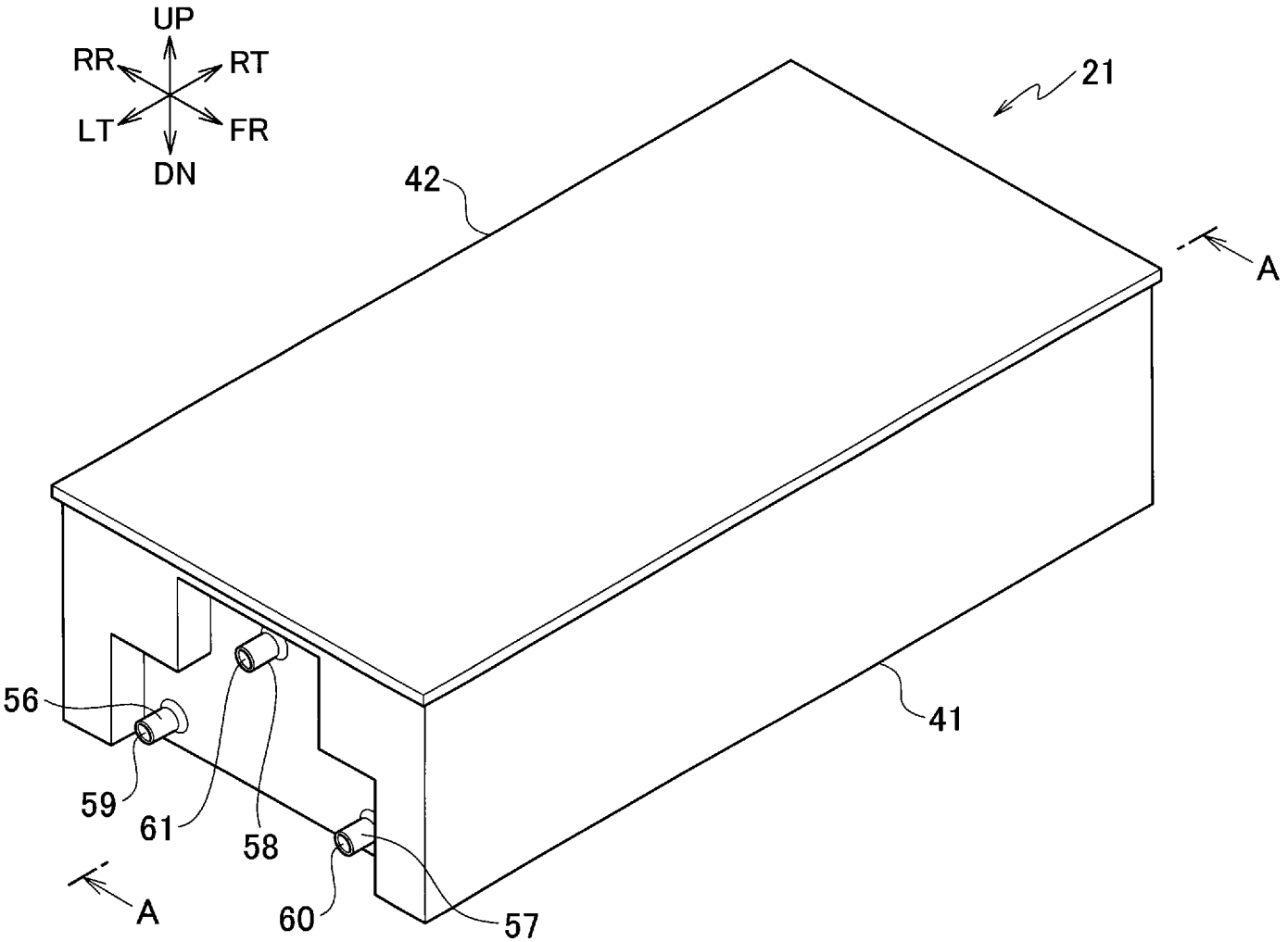
FIG. 2 is a perspective view of the tank.
Figure 3:
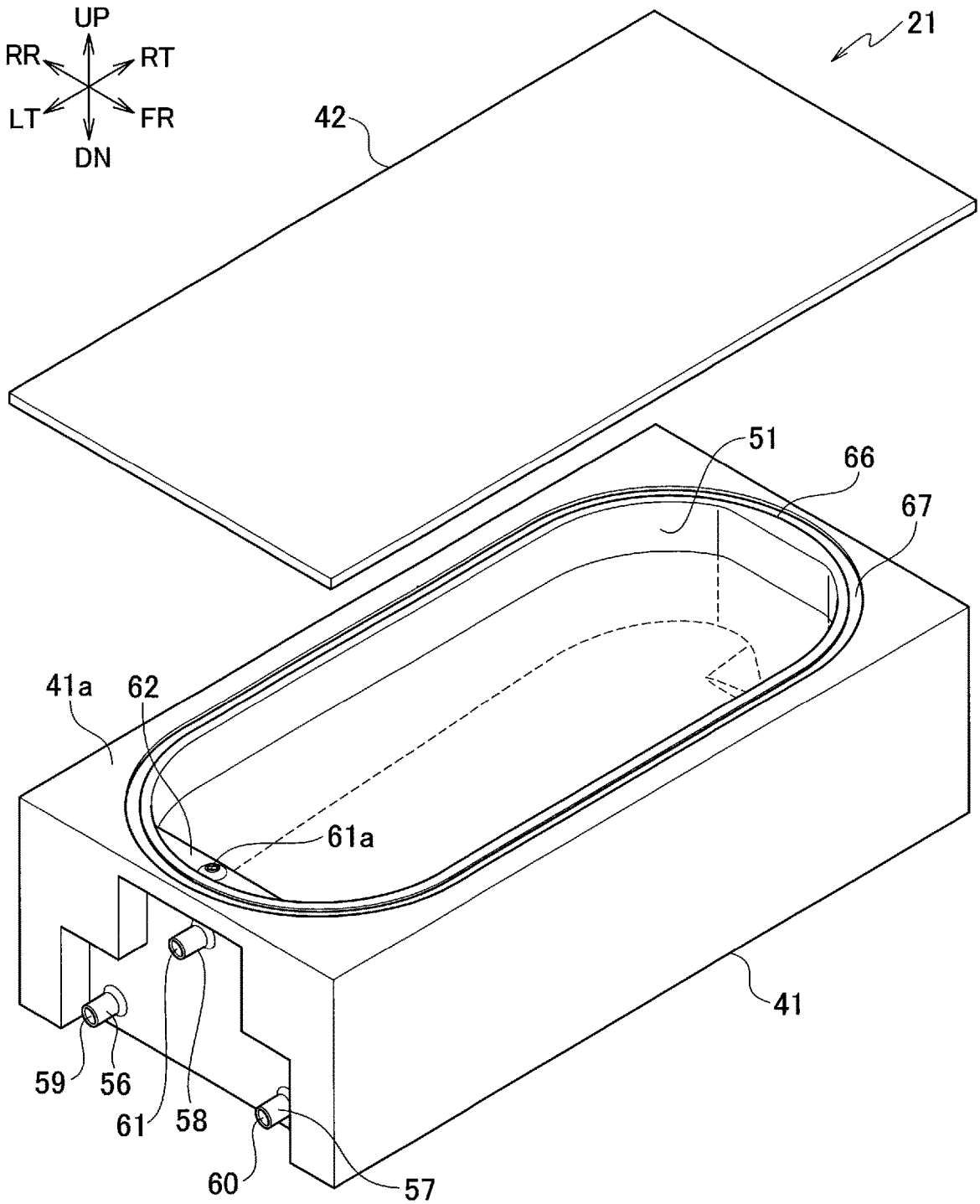
FIG. 3 is an exploded perspective view of the tank.
Figure 4:
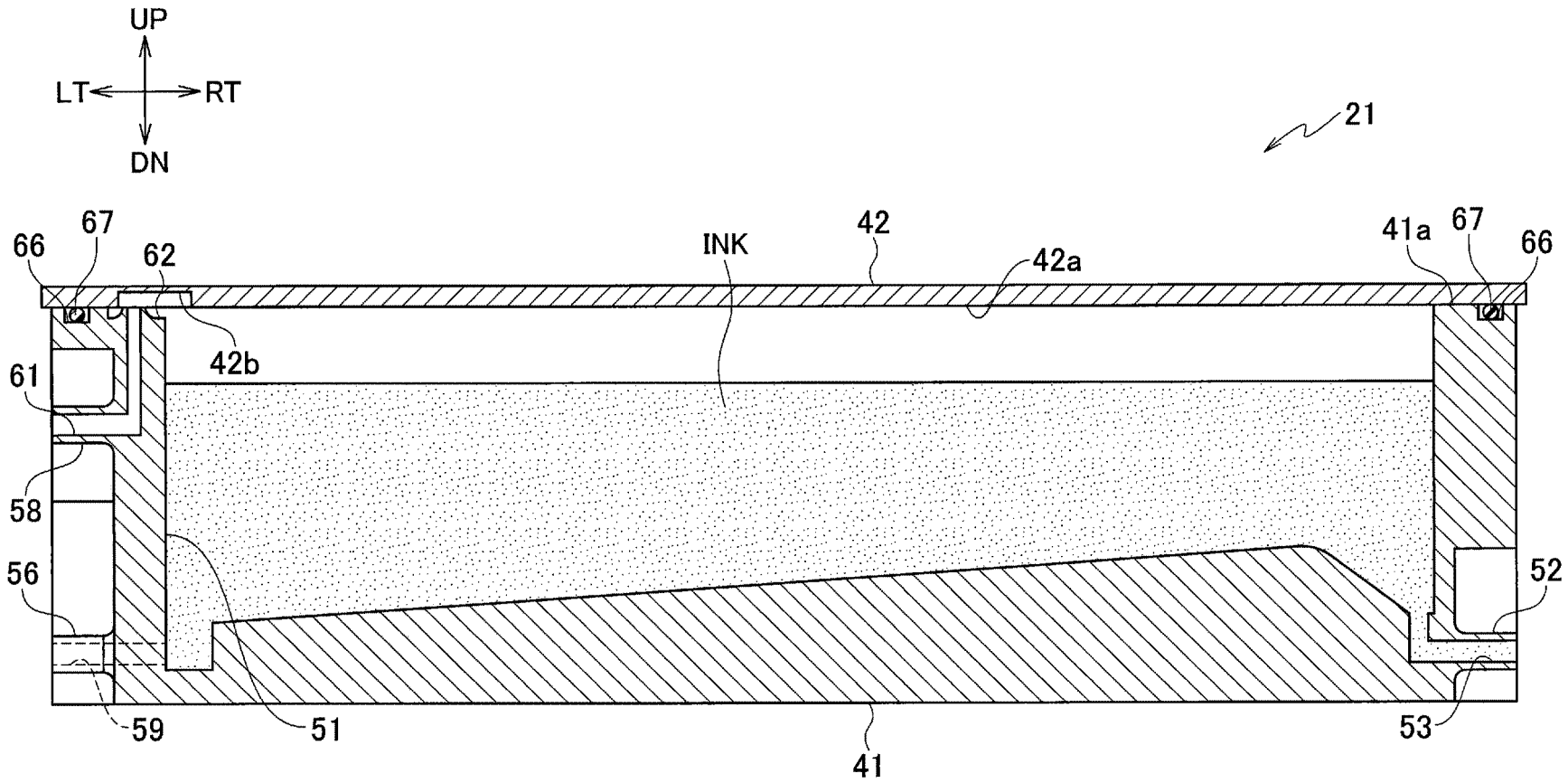
FIG. 4 is a cross-sectional view taken along the line A-A in FIG. 2.
Figure 5:
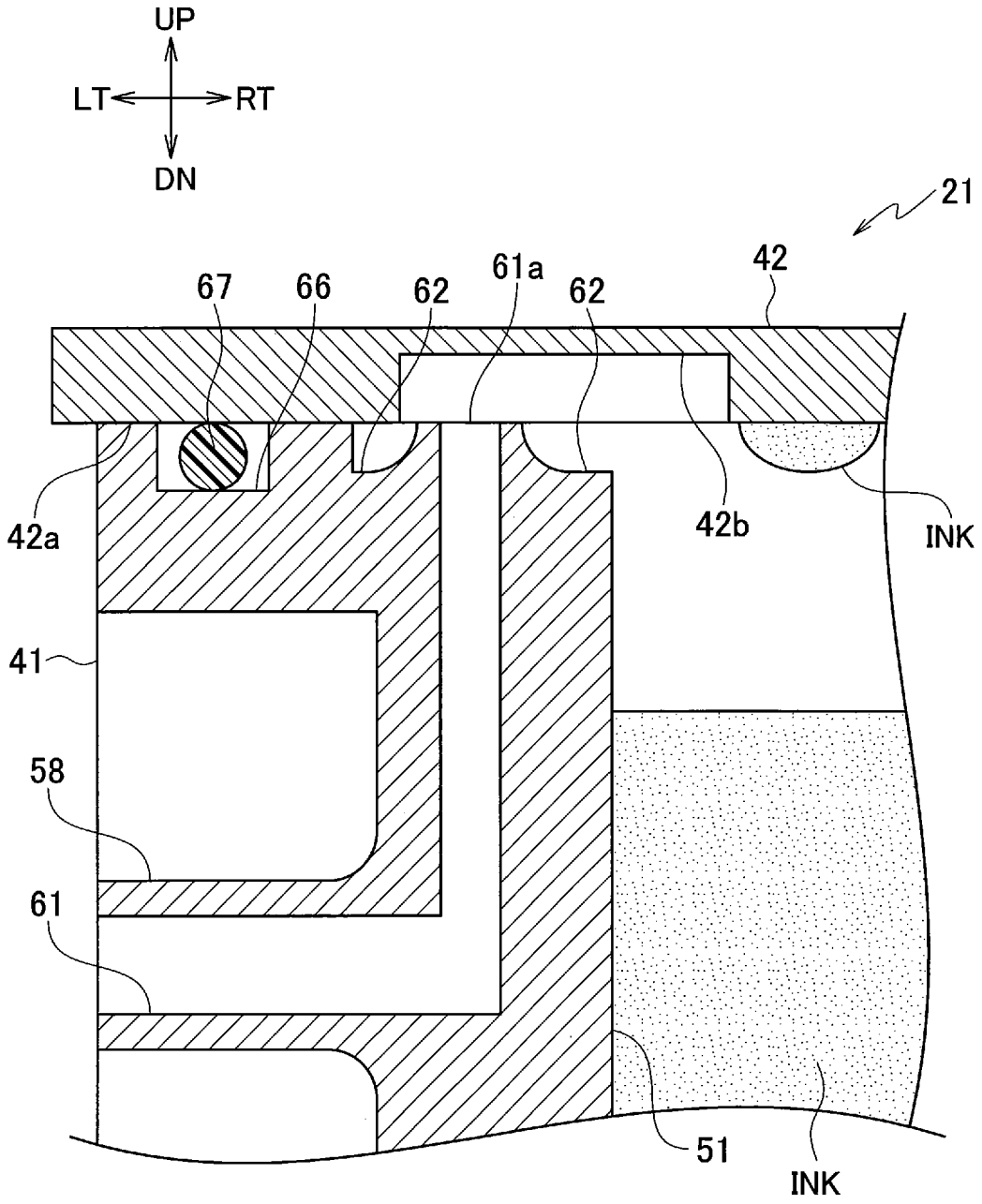
FIG. 5 is a partially-enlarged cross-sectional view taken along the line A-A of FIG. 2.
Figure 6:
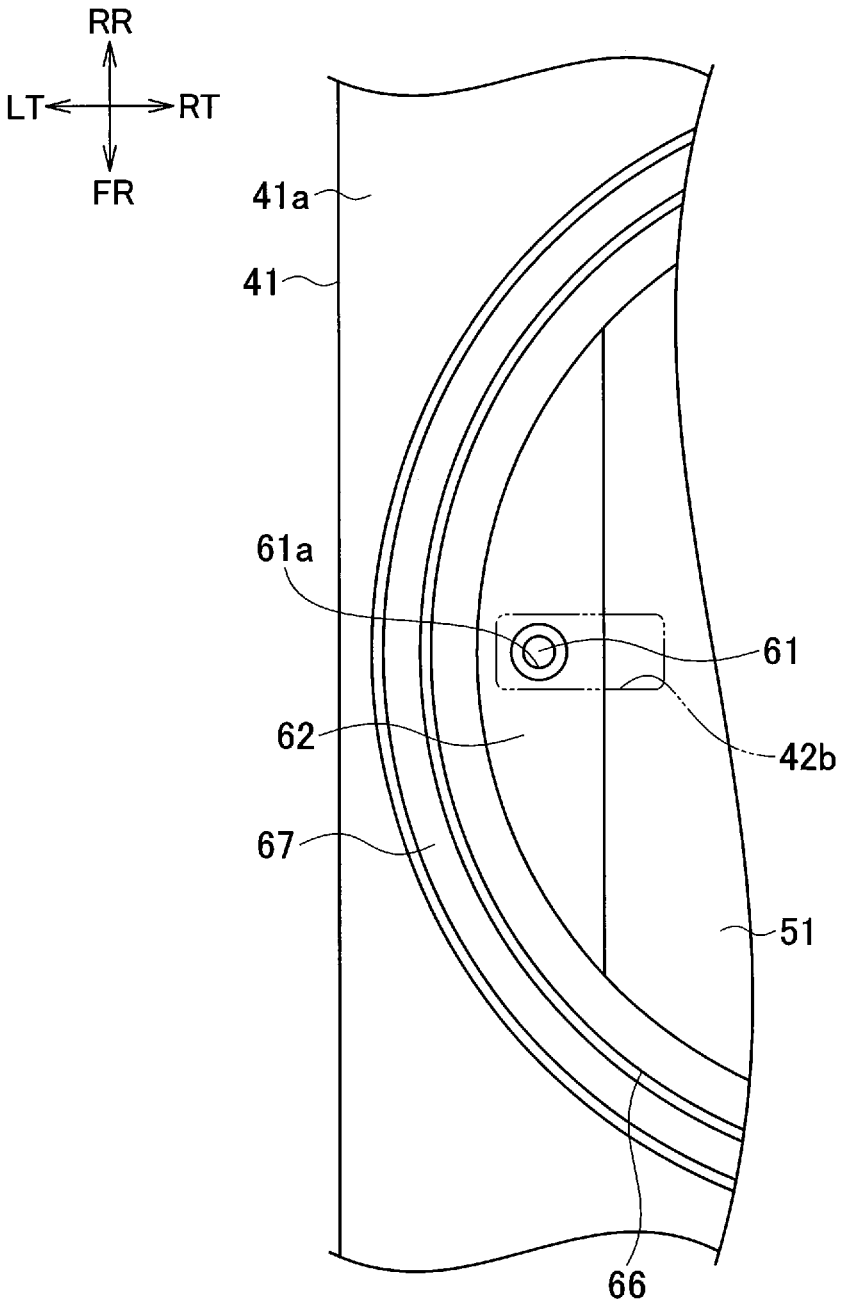
FIG. 6 is an enlarged plan view of a main portion of a tank main body.
Figure 7:
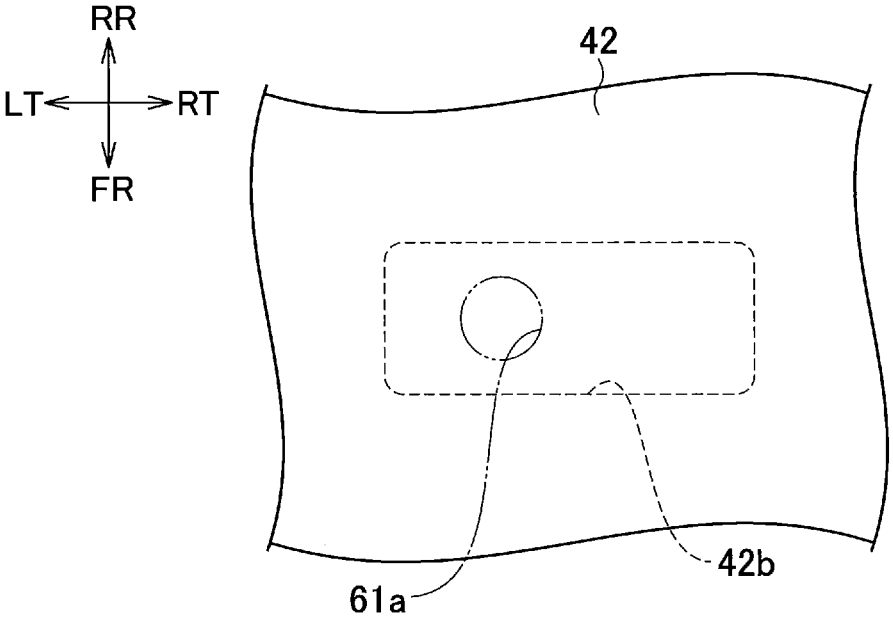
FIG. 7 is an enlarged plan view of a main portion of a lid of the tank.

FIG. 1 is a schematic configuration diagram of a printing apparatus 1 provided with a tank 21 according to an embodiment of the present invention. FIG. 2 is a perspective view of the tank 21. FIG. 3 is an exploded perspective view of the tank 21. FIG. 4 is a cross-sectional view taken along the line A-A in FIG. 2. FIG. 5 is a partially-enlarged cross-sectional view taken along the line A-A of FIG. 2. FIG. 6 is an enlarged plan view of a main portion of a tank main body 41. FIG. 7 is an enlarged plan view of a main portion of a lid 42 of the tank 21. Note that, in the following description, a direction orthogonal to the sheet surface of FIG. 1 is referred to as a front-rear direction and a direction from the sheet surface toward the viewer is referred to as front. Moreover, up, down, left, and right in the sheet surface of FIG. 1 are referred to as directions of up, down, left, and right, respectively. In this case, the up-down direction illustrated in FIG. 1 is the vertical direction. In FIGS. 1 to 10, the directions of right, left, up, down, front, and rear are denoted by RT, LT, UP, DN, FR, and RR, respectively.

As illustrated in FIG. 1, the printing apparatus 1 according to the embodiment includes a printer 2, an ink supplier 3, and a controller 4.

The printer 2 includes an inkjet head (not illustrated) and prints images on a sheet by ejecting ink from the inkjet head to the sheet.

The ink supplier 3 agitates the ink and supplies the ink to the printer 2. The ink supplier 3 includes an ink cartridge 11 and an agitator 12.

In this explanation, the ink used in the printing in the printing apparatus 1 is pigment ink and is ink in which sedimentation of pigment particles may occur when the ink is left at rest. For example, the ink used in the printing in the printing apparatus 1 is a Magnetic Ink Character Reader (MICR) ink containing metal particles which are magnetic bodies. The sedimentation of the pigment particles of the ink leads to defects such as ejection failure in the inkjet head and variation in the concentration of the ejected ink. Since the sedimentation of the pigment particles of the ink may have occurred in the ink cartridge 11, in the printing apparatus 1, the ink is agitated in the agitator 12 to eliminate the sedimentation of the pigment particles if any.

The ink cartridge 11 houses the pigment ink which is the ink to be used for printing by the printer 2. The ink cartridge 11 is configured to be detachably attached to the printing apparatus 1.

The agitator 12 obtains the ink from the ink cartridge 11 and agitates the obtained ink. Moreover, the agitator 12 supplies the agitated ink to the printer 2. The agitator 12 includes the tank 21, an atmosphere opening pipe 22, an air filter 23, an ink transfer pipe 24, an ink flow-out pipe 25, an ink transfer valve 26, an agitation valve 27, a pump 28, an ink supply pipe 29, and an ink supply valve 30.

The tank 21 houses the ink obtained from the ink cartridge 11 for agitation. Details of the tank 21 are described later.

The atmosphere opening pipe 22 forms a flow path of air which opens the tank 21 to the atmosphere. The tank 21 is opened to the atmosphere to maintain the inner pressure of the tank 21 constant (atmospheric pressure) irrespective of changes in the amount of ink in the tank 21. One end of the atmosphere opening pipe 22 is connected to the tank 21 and the other end communicates with the atmosphere via the air filter 23. The air filter 23 prevents dust and the like in the air from entering the atmosphere opening pipe 22.

The ink transfer pipe 24 connects the ink cartridge 11 and the tank 21. The ink transfer pipe 24 forms a transfer route Rt which is a route for transferring the ink from the ink cartridge 11 to the tank 21.

The ink flow-out pipe 25 connects the tank 21 and the ink transfer pipe 24.

An agitation route Rs is formed of the ink flow-out pipe 25 and a portion of the ink transfer pipe 24 on the tank 21 side of a connection portion with the ink flow-out pipe 25. The agitation route Rs is a route through which the ink flows out from the tank 21 and returns to the tank 21.

The ink transfer valve 26 opens and closes a flow path of the ink in the ink transfer pipe 24. The ink transfer valve 26 is arranged in a portion of the ink transfer pipe 24 on the ink cartridge 11 side of the connection portion with the ink flow-out pipe 25.

The agitation valve 27 opens and closes a flow path of the ink in the ink flow-out pipe 25.

The ink transfer valve 26 and the agitation valve 27 switch the route to be opened between the transfer route Rt and the agitation route Rs. Specifically, opening the ink transfer valve 26 and closing the agitation valve 27 sets the transfer route Rt to an open state and sets the agitation route Rs to a closed state. Moreover, closing the ink transfer valve 26 and opening the agitation valve 27 sets the agitation route Rs to an open state and sets the transfer route Rt to a closed state.

The pump 28 agitates the ink in the tank 21 by delivering the ink such that the ink flows out from the tank 21 and returns to the tank 21 through the agitation route Rs. Moreover, the pump 28 is used to transfer the ink from the ink cartridge 11 to the tank 21. The pump 28 is arranged in a portion shared by the transfer route Rt and the agitation route Rs. Specifically, the pump 28 is arranged in the portion of the ink transfer pipe 24 on the tank 21 side of the connection portion with the ink flow-out pipe 25.

The ink supply pipe 29 connects the tank 21 and the printer 2.

The ink supply valve 30 opens and closes a flow path of the ink in the ink supply pipe 29. When the ink supply valve 30 is opened, the ink is supplied from the tank 21 to the printer 2.

The controller 4 controls operations of the units in the printing apparatus 1. The controller 4 includes a CPU, a RAM, a ROM, a hard disk drive, and the like.

Next, details of the tank 21 are described.

As illustrated in FIGS. 2 to 5, the tank 21 includes a tank main body 41 and the lid 42.

The tank main body 41 houses the ink transferred from the ink cartridge 11. The tank main body 41 is formed in a substantially rectangular solid shape.

The tank main body 41 has an ink container 51. The ink container 51 is a portion configured to house the ink (liquid). The ink container 51 is formed by being dug down from an upper surface 41*a* of the tank main body 41.

An ink flow-in port 52 is provided in a right side portion of the tank main body 41. The ink flow-in port 52 is provided to connect the ink transfer pipe 24 to the tank main body 41. An ink flow-in hole 53 is formed in the ink flow-in port 52. The ink flow-in hole 53 communicates with the ink container 51 and the ink flows from the ink transfer pipe 24 into the ink container 51 via the ink flow-in hole 53.

An ink flow-out port 56, an ink supply port 57, and an atmosphere opening port 58 are provided in a left side portion of the tank main body 41.

The ink flow-out port 56 is provided to connect the ink flow-out pipe 25 to the tank main body 41. An ink flow-out hole 59 is formed in the ink flow-out port 56. The ink flow-out hole 59 communicates with the ink container 51 and the ink flows out from the ink container 51 to the ink flow-out pipe 25 via the ink flow-out hole 59.

The ink supply port 57 is provided to connect the ink supply pipe 29 to the tank main body 41. An ink supply hole 60 is formed in the ink supply port 57. The ink supply hole 60 communicates with the ink container 51 and the ink flows out from the ink container 51 to the ink supply pipe 29 via the ink supply hole 60.

The atmosphere opening port 58 is provided to connect the atmosphere opening pipe 22 to the tank main body 41. An atmosphere communication hole 61 is formed in the atmosphere opening port 58. The atmosphere communication hole 61 is provided to cause an interior space (ink container 51) of the tank main body 41 covered with the lid 42 to communicate with the atmosphere and to open the tank 21 to the atmosphere. One end of the atmosphere communication hole 61 is opened in the atmosphere opening port 58 and the other end is opened on the upper surface 41*a* of the tank main body 41.

A lowered step portion 62 formed by being dug down from the upper surface 41*a* of the tank main body 41 is provided around an opening 61*a* of the atmosphere communication hole 61 in the upper surface 41*a* of the tank main body 41. The lowered step portion 62 is formed such that a gap between the lowered step portion 62 and a lower surface 42*a* of the lid 42 is a certain interval. The lowered step portion 62 is formed adjacent to a left side of the ink container 51.

A sealing groove 66 is formed in the tank main body 41. The sealing groove 66 is formed to surround the ink container 51. The sealing groove 66 is a groove for installing a sealing member 67. The sealing member 67 is a member configured to prevent the ink in the ink container 51 from leaking from the tank 21.

The lid 42 covers an upper side of the tank main body 41. The lid 42 is placed on the upper surface 41*a* of the tank main body 41.

The lower surface 42*a* of the lid 42 is provided with a recess 42*b* which faces the opening 61*a* of the atmosphere communication hole 61 and which is formed to be recessed upward.

As illustrated in FIGS. 6 and 7, the recess 42*b* is formed to be larger than the opening 61*a* of the atmosphere communication hole 61 and is formed such that the opening 61*a* fits within a region of the recess 42*b* in a plan view. Moreover, as illustrated in FIGS. 4 and 6, a part of the recess 42*b* is located above the ink container 51 and communicates with the ink container 51. The ink container 51 thus communicates with the atmosphere via the recess 42*b*, the atmosphere communication hole 61, and the atmosphere opening pipe 22.

Moreover, the recess 42*b* is formed in such a shape that entering of the ink into the recess 42*b* by capillary action is impossible. In the embodiment, as illustrated in FIG. 7, the recess 42*b* has a rectangular shape with corners having a rounded shape in the plan view. The radius of the rounded shape is determined depending on the surface tension of the ink and the wettability of the lid 42 such that entering of the ink into the recess 42*b* by capillary action can be prevented.

Next, operations of ink transfer from the ink cartridge 11 to the tank 21 and ink agitation in the agitator 12 in the printing apparatus 1 are described.

When a sensor (not illustrated) detects that a liquid level height of the ink in the tank 21 reaches or falls below a predetermined lower limit height, the ink is transferred from the ink cartridge 11 to the tank 21.

In this case, the controller 4 opens the ink transfer valve 26 and closes the agitation valve 27. This sets the transfer route Rt to the open state and sets the agitation route Rs to the close state. In this case, a new ink cartridge 11 is attached to the printing apparatus 1.

Next, the controller 4 starts drive of the pump 28. The ink is thereby transferred from the ink cartridge 11 to the tank 21 via the transfer route Rt.

When all ink in the ink cartridge 11 is transferred to the tank 21, the controller 4 closes the ink transfer valve 26 and opens the agitation valve 27. This switches the agitation route Rs to the open state and the transfer route Rt to the closed state. Then, the ink is circulated along the agitation route Rs and the ink in the tank 21 is agitated.

When specified time elapses from start of the agitation of the ink in the tank 21, the controller 4 stops the pump 28 and closes the agitation valve 27. The agitation operation of the ink by the agitator 12 is thereby completed.

The ink transferred to the tank 21 and agitated as described above is supplied to the printer 2 in the printing by the printer 2 as necessary.

The agitation operation of the ink in the agitator 12 is regularly performed, for example, every predetermined time, in addition to the moment just after the aforementioned transfer of the ink from the ink cartridge 11 to the tank 21, to prevent the sedimentation of the pigment particles of the ink in the tank 21.

In this case, when the ink is transferred from the ink cartridge 11 to the tank 21 and when the ink flows into the tank 21 in the agitation operation by the agitator 12, the ink sometimes splashes and attaches to the lid 42 as illustrated in FIG. 5. Moreover, the ink attaching to the lid 42 sometimes moves along the lid 42.

Most of the ink which has moved along the lid 42 to a portion near the opening 61*a* of the atmosphere communication hole 61 comes into contact with the lowered step portion 62 and flows down to the lowered step portion 62. Since the opening 61*a* is located above the lowered step portion 62, the ink can be prevented from entering the atmosphere communication hole 61 from the lowered step portion 62. Specifically, the ink which has moved from the lid 42 to the tank main body 41 can be prevented from entering the atmosphere communication hole 61 from a periphery of the opening 61*a* in the tank main body 41.

Moreover, since the recess 42*b* which faces the opening 61*a* and which is recessed upward is provided in the lid 42, the ink is prevented from moving to a position directly above the opening 61*a*. Thus, the ink is prevented from entering the atmosphere communication hole 61 directly from the lid 42. In this case, since entering of the ink into the recess 42*b* by capillary action is prevented, the ink is surely prevented from moving to the position directly above the opening 61*a*.

Moreover, since the part of the recess 42*b* is located above the ink container 51 which is a region outside the lowered step portion 62 and lower than the lowered step portion 62, the recess 42*b* provides a large air flow path to the lowered step portion 62 and facilitates flow of the ink from the lowered step portion to the ink container 51. This prevents the ink from accumulating in the lowered step portion 62 and entering the atmosphere communication hole 61.

As described above, the following case is prevented from occurring: the ink attaching to the lid 42 enters the atmosphere communication hole 61 and isolates the inside of the tank 21 from the atmosphere, thereby making it impossible to maintain the constant inner pressure (atmospheric pressure).

As described above, in the printing apparatus 1, the tank main body 41 has the lowered step portion 62 formed by digging down from the periphery of the opening 61*a* of the atmosphere communication hole 61. Moreover, the lid 42 has the recess 42*b* formed on the lower surface 42*a* of the lid 42 to face the opening 61*a*. Accordingly, even when the ink moves along the lid 42 to the portion near the opening 61*a*, the ink is prevented from entering the atmosphere communication hole 61. As a result, the printing apparatus 1 can prevent the ink from entering the atmosphere communication hole 61.

Moreover, since the recess 42*b* has such a shape that entering of the ink into the recess 42*b* by capillary action is impossible, the ink can be prevented from moving to the position directly above the opening 61*a*. Thus, the ink can be prevented from entering the atmosphere communication hole 61.

Furthermore, since the part of the recess 42*b* is located above the ink container 51, the flow of the ink from the lowered step portion 62 to the ink container 51 is facilitated. Thus, the ink is prevented from accumulating in the lowered step portion 62 and entering the atmosphere communication hole 61. The ink can be thereby further prevented from entering the atmosphere communication hole 61.

Figure 8:
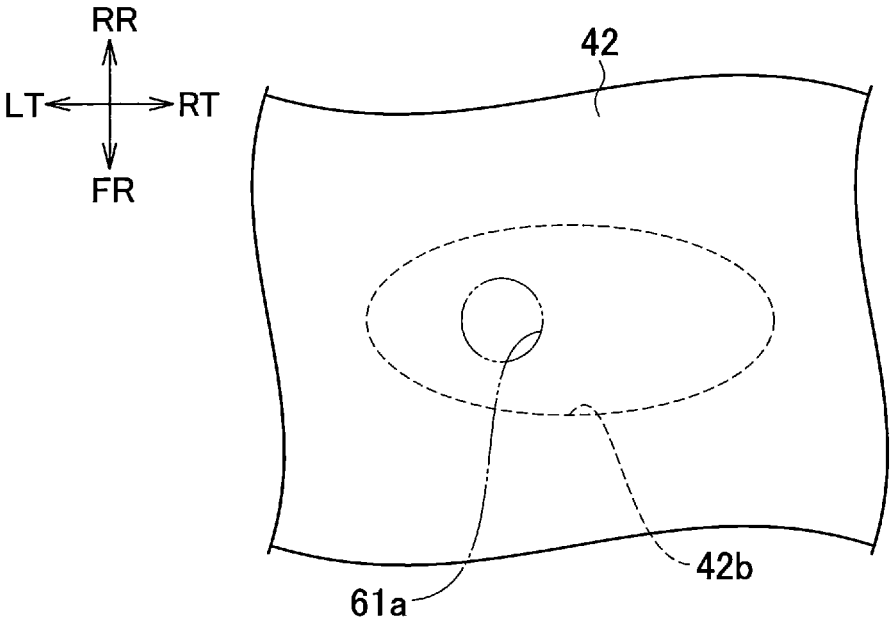
FIG. 8 is a view illustrating a modified example of a shape of a recess in a plan view.

Note that, although the case where the recess 42*b* has the rectangular shape with corners having a rounded shape in the plan view is described in the aforementioned embodiment, the shape of the recess 42*b* is not limited to this. For example, as illustrated in FIG. 8, the recess 42*b* may have an ellipsoid shape in the plan view.

Figure 9:
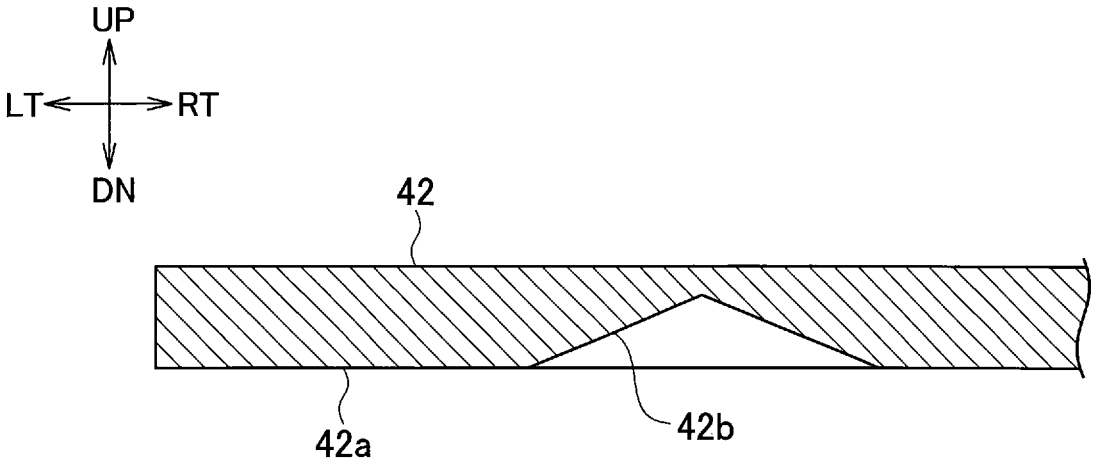
FIG. 9 is a view illustrating a modified example of a cross-sectional shape of the recess.
Figure 10:
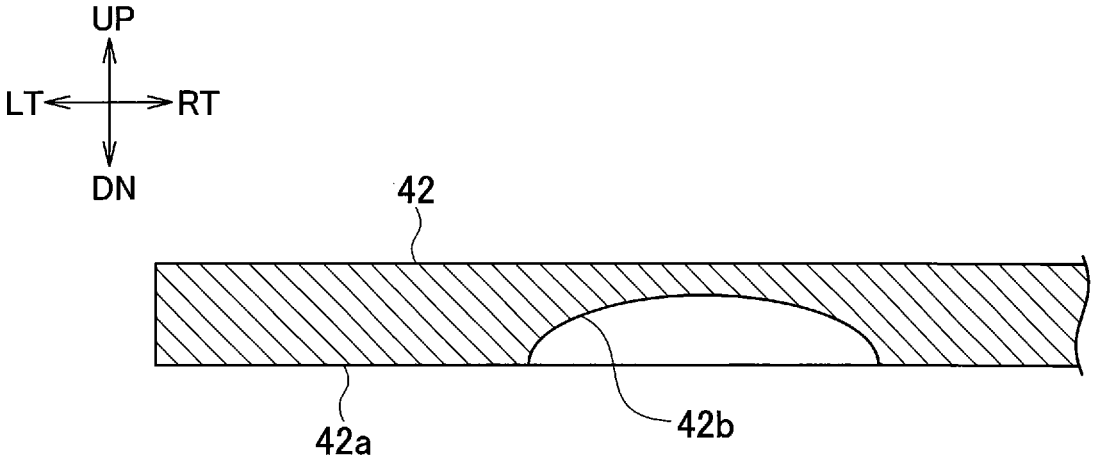
FIG. 10 is a view illustrating another modified example of the cross-sectional shape of the recess.

Moreover, although the case where the cross-sectional shape of the recess 42*b* is a rectangular shape as in FIG. 5 is described in the aforementioned embodiment, the cross-sectional shape of the recess 42*b* is not limited to this. For example, the recess 42*b* may have a triangular cross section as illustrated in FIG. 9 or a semi-ellipsoid cross section as illustrated FIG. 10.

Furthermore, the recess 42*b* may have a shape including a portion which sucks in the ink by capillary action. Also in this case, the ink can be prevented from entering the atmosphere communication hole 61 directly from the lid 42 as long as the recess 42*b* has such a shape that the amount of the ink entering the recess 42*b* by capillary action is sufficiently small.

Moreover, the lowered step portion 62 may be tilted downward toward the ink container 51 (right side). In this case, the flow of the ink from the lowered step portion 62 to the ink container 51 is facilitated.

Moreover, although the configuration in which the part of the recess 42*b* is located above the ink container 51 is described in the aforementioned embodiment, the configuration may be such that the part of the recess 42*b* is located above a region other than the ink container 51 which is outside the lowered step portion 62 and which is lower than the lowered step portion 62.

Moreover, although the case where the ink in which the sedimentation of the pigment particles occurs is agitated is described in the aforementioned embodiment, the ink to be agitated is not limited to the ink in which the sedimentation of the contents occurs. For example, the ink to be agitated may be ink in which separation of contents occurs.

Furthermore, the present invention can be applied also to a tank housing liquid other than the ink.

Embodiments of the disclosure include, for example, the following configuration.

A tank includes a tank main body configured to house liquid and a lid configured to cover an upper side of the tank main body. The tank main body includes an atmosphere communication hole having an opening opened on an upper surface of the tank main body and a lowered step portion dug down from a periphery of the opening. The lid includes a recess formed on a lower surface of the lid and facing the opening.

The recess may have a shape capable of preventing entrance of liquid into the recess by capillary action.

A part of the recess may be located above a region which is outside the lowered step portion and which is lower than the lowered step portion.

Embodiments of the present invention have been described above. However, the invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

Moreover, the effects described in the embodiments of the present invention are only a list of optimum effects achieved by the present invention. Hence, the effects of the present invention are not limited to those described in the embodiment of the present invention.

What is claimed is:

1. A tank comprising:

a tank main body configured to house liquid; and a lid configured to cover an upper side of the tank main body, wherein the tank main body comprises:

an atmosphere communication hole having an opening opened on an upper surface of the tank main body; and a lowered step portion dug down from a periphery of the opening, and the lid comprises a recess formed on a lower surface of the lid and facing the opening.

2. The tank according to claim 1 wherein a part of the recess is located above a region which is outside the lowered step portion and which is lower than the lowered step portion.

3. The tank according to claim 1, wherein the lower surface of the lid faces the liquid, and the recess faces the liquid.

4. The tank according to claim 1, wherein the recess has a shape capable of preventing entrance of liquid into the recess by capillary action.

5. The tank according to claim 4 wherein a part of the recess is located above a region which is outside the lowered step portion and which is lower than the lowered step portion.

* * * * *